US011105095B2

(12) United States Patent
Giles

(10) Patent No.: US 11,105,095 B2
(45) Date of Patent: Aug. 31, 2021

(54) CONSTRUCTION MODULE AND METHOD OF USE THEREOF

(71) Applicant: OGEL Blocks, Durham (GB)

(72) Inventor: Gary Giles, Durham (GB)

(73) Assignee: Products of Mass Construction Ltd., Teeside (GB)

( * ) Notice: Subject to any disclaimer, the term of this patent is extended or adjusted under 35 U.S.C. 154(b) by 0 days.

(21) Appl. No.: 16/497,043

(22) PCT Filed: Mar. 29, 2018

(86) PCT No.: PCT/GB2018/050878
§ 371 (c)(1),
(2) Date: Sep. 24, 2019

(87) PCT Pub. No.: WO2018/178716
PCT Pub. Date: Oct. 4, 2018

(65) Prior Publication Data

US 2020/0378117 A1 Dec. 3, 2020

(30) Foreign Application Priority Data

Mar. 29, 2017 (GB) ..... 1705006

(51) Int. Cl.
*E04C 1/00* (2006.01)
*E04B 2/42* (2006.01)
*E04B 2/02* (2006.01)

(52) U.S. Cl.
CPC ..... *E04C 1/00* (2013.01); *E04B 2/42* (2013.01); *E04B 2002/0204* (2013.01); *E04B 2002/0247* (2013.01)

(58) Field of Classification Search
CPC ..... E04C 1/00; E04C 1/39; E04B 2/42; E04B 2/0204; E04B 2/02; E04H 1/02; E01F 8/00; F16B 5/07
USPC ..... 52/574
See application file for complete search history.

(56) References Cited

U.S. PATENT DOCUMENTS 4,106,254 A * 8/1978 Jack ..... B27F 1/005 217/65
4,601,148 A * 7/1986 Risi ..... E04C 1/395 52/284
4,905,442 A * 3/1990 Daniels ..... E04C 2/08 403/345
5,575,119 A * 11/1996 Wolfowitz ..... E04B 2/18 52/271
5,833,351 A * 11/1998 Marsh ..... E04C 1/39 362/145
7,568,323 B2 * 8/2009 Shelton ..... E04C 3/06 52/579

(Continued)

FOREIGN PATENT DOCUMENTS

DE 10034567 A1 1/2001
FR 2438313 A1 4/1980

*Primary Examiner* — Paola Agudelo
(74) *Attorney, Agent, or Firm* — Gable Gotwals

(57) ABSTRACT

A construction module for constructing a structure, including an elongate member having a substantially L-shaped cross-section provided with connecting portions arranged to detachably attach with connecting portions on second and further construction modules, to form structure. A temporary structure can be formed from two or more of the construction modules. The structure may be temporary, semi-permanent or permanent.

15 Claims, 8 Drawing Sheets

(56) References Cited

U.S. PATENT DOCUMENTS

Figure 1A:
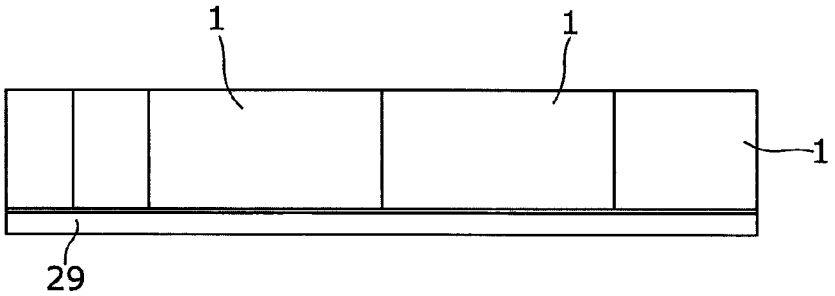

| | | | | |
|---|---|---|---|---|
| 8,117,802 | B1 * | 2/2012 | Kisch | E04C 3/127<br>52/844 |
| 8,820,023 | B2 * | 9/2014 | Nam | E04B 2/14<br>52/603 |
| 2007/0266671 | A1 * | 11/2007 | Chromy | E04C 3/06<br>52/844 |
| 2015/0059278 | A1 * | 3/2015 | Rainio | E04C 1/395<br>52/431 |
| 2016/0281357 | A1 * | 9/2016 | Aribas | E04B 2/18 |
| 2017/0159687 | A1 * | 6/2017 | Jung | H05K 5/03 |

* cited by examiner 1
1'
1'
1
29

27'
5'
1'
3'
15
21
13'
15
25'
11
1
3
9
27
5
7
29
21
9
25
13
11'

19
19
27'
5'
25'
19
13'
21
11
17
1
3
27
31
5
29
21
25
19
13
11'
17
3'
1'
31

11
515
1
515
515
3
13
25
5
515
27

11
3
515
1
13
5
515

5'
3'
1'
515'
515
515
1

13'
11
515
11'
13
515

CONSTRUCTION MODULE AND METHOD OF USE THEREOF

CROSS-REFERENCE TO RELATED APPLICATIONS

This United States application is the National Phase of PCT Application No. PCT/GB2018/050878 filed 29 Mar. 2018, which claims priority to British Patent Application No. 1705006.3 filed 29 Mar. 2017, each of which is incorporated herein by reference.

The invention to which this application relates is a construction module for a temporary, semi-permanent or permanent structure and a method of use thereof. Although the following description refers exclusively to the construction of temporary structures in the form of walls, barriers or buildings, the person skilled in the art will appreciate that the present invention could also be used for structures of a semi-permanent or permanent nature, depending on usage requirements.

Temporary structures in the form of buildings, shelters, walls barriers and the like have been known for some time. In general, they comprise a kit of numerous parts and modules that require assembly and subsequent disassembly as required. The advantages of such systems are that the disassembled parts can be packed tightly and efficiently for storage and transport. However, such modular structures involve a large number of distinct components parts and can therefore be quite complex, meaning the construction of even basic temporary structures can be complicated and time consuming. Each component part is also therefore provided to serve a specific purpose and forms a particular part of the structure.

Other modular systems exist wherein the construction of such structures is made relatively simple by the provision of fewer distinct components parts. An example of this is the system employed under the name "EverBlock Systems®". This system provides building blocks that link and connect much in the same fashion as the well-known Lego® toy; only they are provided to build "life-size" constructions. Linking portions are provided to connect building blocks vertically above and below each other, but there is no linkage between blocks laterally—walls are built in a traditional brick fashion and so adjacent blocks are only connected indirectly via a shared block above and/or below them. Furthermore, because of the brick-like nature of the blocks, the parts of such a system are bulky and require a large volume when being stored or transported, which significantly increases such costs. There is therefore a need to provide an improved means to construct temporary structures that make storage, transportation and construction much more simple, convenient and efficient.

It is therefore an aim of the present invention to provide a construction module that overcomes the aforementioned problems associated with the prior art.

It is a further aim of the present invention to provide a temporary structure that overcomes the aforementioned problems associated with the prior art.

It is yet a further aim of the present invention to provide a method of using a construction module to build a temporary structure that overcomes the aforementioned problems associated with the prior art.

According to a first aspect of the invention there is provided a construction module for constructing a structure, said module comprising an elongate member having a substantially L-shaped cross-section, said member provided with connecting portions arranged to detachably attach with connecting portions on second and further construction modules, to form said structure.

In one embodiment, said structure may be a temporary structure. In other embodiments of the present invention, the structure may be a permanent or semi-permanent structure. While the following refers predominantly to the use of construction modules according to the present invention for use with temporary structures, it will be appreciated that the module may also be used to form semi-permanent or permanent structures, as required.

In one embodiment, said connecting portions are arranged to detachably attach with complementary connection portions on second and further construction modules. Typically, said connecting portions permit tessellated attachment of said module to second and further construction modules.

In one embodiment, at least some of said connection portions are arranged to permit detachable attachment of said module to second and/or further modules rotated 180 degrees thereto.

In one embodiment, the module is detachably attachable to second and/or further modules, positioned offset along the length of the first module.

Thus, the present invention provides a new and convenient solution overcoming the problems with the prior art. The construction module of the present invention is provided with an L-shaped cross section such that it is easily and conveniently stored, packaged and transported as required. The module is also therefore lightweight compared to other systems and is subsequently easily connected to further modules, ultimately forming a temporary structure. The structure, wall or barrier required to be built may be done so from a single principle component, which may be joined to adjacent modules and further modules by rotating and tessellating. Thus, there is no requirement for multiple and complex connecting or joining parts as per systems currently available.

In one embodiment, the construction module includes at least two panels provided adjacent and substantially at right-angles to one another, along the length of said module. Typically, said panels are connected along proximal edges thereof. Further typically, said panels are connected so as to form said L-shape in cross-section.

In one embodiment, a first of said at least two panels is provided to be a substantially vertical panel, forming at least part of a face on a side of said module and, in some embodiments, said temporary structure. Typically, said panel forms at least part of a barrier portion of said temporary structure.

In one embodiment, a second of said at least two panels is provided to be a substantially horizontal panel, forming at least part of a base, floor or top of said module and, in some embodiments, said temporary structure.

Typically, said first and second panels comprise interior and exterior faces, with respect to the L-shaped cross-section.

In one embodiment, one or more rib members are provided on said first panel. Typically, said one or more rib members are located along the length of the first panel and, thus, the length of the module. Further typically, said one or more rib members are located on an interior face of said first panel.

In one embodiment, said one or more rib members may be provided with a substantially C- or T-shaped cross-section. Typically, said one or more rib members are arranged to receive one or more joining members. Thus, further lateral engagement between adjacent modules may be provided, strengthening attachment between such modules.

In one embodiment, one or more rib members may be provided on said second panel, located along the length thereof. Further typically, said one or more rib members are located on an interior face of said second panel.

In one embodiment, an exterior face of said first panel is provided with a substantially flat or even surface.

In one embodiment, one or more apertures may be provided located in said first panel. Typically, said one or more apertures may be located at or near a distal edge of said panel, i.e., an edge opposite that which adjoins said second panel.

In one embodiment, one or more apertures may be provided located in said second panel. Typically, said one or more apertures may be located at or near a proximal and/or distal edge of said panel.

In one embodiment, one or more recesses or channel members may be provided on said second panel. Typically, said one or more recesses or channel members may be provided along the length of said second panel and, thus, the length of the module. Further typically, said recesses or channel members are located on an exterior face of said second panel.

In one embodiment, a first connecting portion is provided on said first panel, and at least a second connecting portion is provided on said second panel.

In one embodiment, said first and second connecting portions are located at or near distal edges of said first and second panels. Typically, said connecting portions are located along the length of said edges and, thus, along the length of said module.

In one embodiment, said first connecting portion is arranged to be detachably attachable to a complementary second connecting portion on a second and/or further construction module. Typically, said second connecting portion is arranged to be detachably attachable to a complementary first connecting portion on a second and/or further construction module.

Typically, said second connecting portion is located on an interior face of the second panel, at and along a distal edge thereof.

In one embodiment, said connecting portions form detachable attachments with complementary portions via linear engagement. Typically, said engagement is via a male-female attachment. Further typically, said attachment is a push-fit or snap-fit engagement.

In one embodiment, said connecting portions form detachable attachments with complementary portions via a tongue and groove arrangement. Typically, said first connecting portion is provided as a groove, slot, trough or channel member along a distal edge of said first panel. Further typically, said groove, slot, trough or channel member is provided on an interior face of said first panel, and has a direction of attachment substantially parallel to the plane of said first panel.

In one embodiment, said second connecting portion is provided as a tongue, ridge or projecting member along a distal edge of said second panel. Typically, said tongue, ridge or projecting member is located on an interior face of said second panel, and has a direction of attachment substantially perpendicular to the plane of said second panel.

In another embodiment, said first connecting portion may be provided as a tongue, ridge or projecting member along a distal edge of said first panel, and said second connecting portion may be provided as a groove, slot, trough or channel member along a distal edge of said second panel. Typically, said groove, slot, trough or channel member may be provided on an interior face of said second panel, and has a direction of attachment substantially parallel to the plane of said second panel.

In one embodiment, the module may be provided with further connecting portions. Typically, a third connecting portion is provided along a distal edge of said second panel, located on an exterior face thereof. Further typically, a fourth connecting portion is provided along a proximal edge of said second panel, located on an exterior face thereof.

In one embodiment, said third and fourth connecting portions have a direction of attachment substantially perpendicular to the plane of said second panel.

In one embodiment, said third connecting portion is arranged to be detachably attachable to a complementary fourth connecting portion on a second and/or further construction module. Typically, said fourth connecting portion is arranged to be detachably attachable to a complementary third connecting portion on a second and/or further construction module.

In another embodiment, said third and fourth connecting portions are provided for detachable attachment to connecting portions located on a base, floor or track member on which the module may be located and, thus, a temporary, semi-permanent or permanent structure may be constructed.

In one embodiment, said one or more recesses or channel members provided on the second panel may be arranged to receive at least part of one or more joining, reinforcement and/or support members, and/or one or more cables or wires and the like, to be located between adjacent, stacked and/or adjoining modules.

In one embodiment, a first recess of channel may be provided for the receipt of one or more wires, cables and the like therethrough, and at least a second recess may be provided for the receipt of at least part of one or more joining, reinforcement and/or support members.

Typically, at least one recess or channel member is provided shaped to receive at least part of a joining, reinforcement and/or support member.

In one embodiment, the module further includes at least one joining, reinforcement and/or support member provided in the form of and elongate member. Typically, said joining member is provided to be located between adjacent, stacked and/or adjoining modules, joining the same together. Preferably, at least a first portion of said joining member is located in a recess or channel member of a first module, and a second portion of said joining member is located in a recess or channel member of a second module.

In one embodiment, said joining member has a cross-sectional profile shaped so as to prevent the separation of adjacent, stacked and/or adjoining modules. In one embodiment, said joining member has an hour-glass or similar-shaped cross-sectional profile.

Thus, the provision of a joining member as described above serves to add further stability and connectivity between adjacent, stacked and/or adjoining modules, thereby improving the overall structural integrity of a structure formed from a plurality of construction modules.

In one embodiment, at least a portion of said second panel may be mitred or bevelled. Typically, said mitring or bevelling may permit the module to act as a corner member of a temporary structure. In another embodiment, at least a portion of said second panel may be extended at a predetermined angle. Typically, said extension may permit the module to act as a corner member of said temporary structure.

In one embodiment, one or more plate members may be provided associated with the module. Typically, said one or more plate members may be provided to act as joining, reinforcement and/or support members.

In one embodiment, said one or more plate members are provided to be located within the L-shaped profile/cross-section of the module. Typically, said plate member includes one or more formations and/or recesses about edges thereof which are shaped to engage one or more rib members provided on said module.

In one embodiment, said plate member may include one or more recesses having substantially T-shaped profiles, and provided to engage one or more rib members with substantially T-shaped profiles. In another embodiment, said plate member may include one or more formations having substantially T-shaped profiles, and provided to engage one or more rib members on said module provided with substantially C-shaped profiles.

Typically, said plate member has an outer profile shaped to complement the inner profile of the L-shaped construction module. That is to say, the periphery of the plate member has a profile to complement the profile of the interior faces of the first and second panels forming the construction module.

In one embodiment, said plate member may be provided to act as an end plate, located at an end of, and within, two connected modules, said module being provided at 180 degrees relative to one another and connected, so as to form a substantially rectangular profile.

Preferably, said one or more plate members are detachably attachable to said module via a sliding and/or friction fit arrangement of said formations and/or recesses with said module. Typically, said sliding and friction fit arrangement may be enable via the provision of a clamp and release mechanism.

In one embodiment, a plurality of plate members may be provided connected with a module. Typically, said plurality of plate members serves to reinforce a structure formed by the connection of multiple construction modules.

In one embodiment, said plate member may include one or more apertures located therethrough. Typically, said aperture may be provided to enable the connection of said plate member to another article, structure or the like. in another embodiment, said apertures may be provided to permit one or more cables, wires or the like to be fed therethrough.

In another aspect of the present invention, there is provided a construction module for constructing a structure, said module comprising an elongate member having a substantially L-shaped cross-section, said member provided with connecting portions arranged to detachably attach with complementary connecting portions on second and further construction modules in a tessellating manner, to form said structure.

In another aspect of the present invention, there is provided a structure formed from the provision of at least two or more construction modules as described above.

In another aspect of the present invention, there is provided a structure, said structure including: two or more construction modules detachably attached to one another; each module comprising an elongate member having a substantially L-shaped cross-section, said member provided with connecting portions arranged to detachably detach with connecting portions on the other and further construction modules, to form said structure.

In one embodiment, said structure may be a temporary structure. In other embodiments of the present invention, the structure may be a permanent or semi-permanent structure. Where a temporary structure is referred to, by way of example, it will be appreciated that there may also be provided semi-permanent or permanent structures, as required.

In one embodiment, said structure comprises a first plurality of construction modules located adjacent one another along a longitudinal axis. Typically, a second plurality of construction modules are provided located adjacent one another along a longitudinal axis and rotated 180 degrees with respect to said first plurality of construction modules. Further typically, said rotation is about the longitudinal axis of the construction modules. Further typically, said second plurality of construction modules is provided to detachably attach to said first plurality.

In one embodiment, construction modules of the second plurality are positioned offset from construction modules of the first plurality when detachably attached thereto. Typically, said modules are provided offset along the longitudinal axis thereof.

In one embodiment, combinations of attached first and second pluralities of constructions modules may be provided in two or more rows or layers. Thus, in building a structure as such, the height may be varied as required by a user simply by adding or removing layers or rows of constructions modules.

In one embodiment, the detachable attachment of said construction modules provides, for example, a temporary structure having a square or rectangular-shaped cross-section. Typically, attachment of a first plurality of construction modules and a second plurality of construction modules provides a temporary structure having a substantially hollow interior.

In one embodiment, one or more apertures may be provided located in first and/or second panels of the said construction modules. Typically, said one or more apertures may be located at or near a distal edge of said panels.

In one embodiment, said temporary structure is provided to be fillable with solid and/or liquid material.

Thus, as the construction modules of the temporary structure are conveniently shaped so as to be easily packed, stored and transported, once built and forming the temporary structure, the interior of said structure can be hollow and subsequently filled, thereby fortifying the structure. For example, if a solid barrier or wall is required, or multiple walls forming a temporary building using the construction modules is needed, the layers and rows of the structure may be filled with rubble, sand, stones and/or other appropriate material to add weight and strength to the structure. Apertures provided in the horizontal panels of the construction modules therefore allow any material poured in from the top to dissipate downwards, preventing there from being too much weight higher up the structure and over-balancing it or providing it with too high a centre of gravity. Apertures may also be provided in the vertical panels in examples where the temporary structure is to be used as a flood barrier. In such instances a degree of weight may already be added to the layers and rows by at least partially filling the same with rubble, sand, stones and/or other appropriate material. Any floodwater, as it hits the barrier, may subsequently feed into the wall, which serves two purposes: firstly it naturally fills the wall to add to its weight, fortifying it; and secondly it enables the structure to absorb and dissipate the energy and force of the floodwater as it hits the barrier, thereby enabling it to maintain its structural integrity more efficiently.

In one embodiment, the construction modules forming said temporary structure comprise first, vertical panels, and second, horizontal panels, thereby forming said L-shaped cross-section.

In one embodiment, a first connecting portion is provided on a first panel of the construction modules, and at least a second connecting portion is provided on a second panel of the construction modules.

In one embodiment, said first and second connecting portions are located at or near distal edges of said first and second panels. Typically, said connecting portions are located along the length of said edges and, thus, along the length of said modules.

In one embodiment, the first connecting portions on a first module are arranged to be detachably attachable to complementary second connecting portions on a second and/or further construction modules. Typically, said second connecting portions on a first module are arranged to be detachably attachable to complementary first connecting portion on second and/or further construction modules.

In one embodiment, the modules may be provided with further connecting portions. Typically, a third connecting portion is provided along a distal edge of said second panel, located on an exterior face thereof. Further typically, a fourth connecting portion is provided along a proximal edge of said second panel, located on an exterior face thereof.

In one embodiment, said third and fourth connecting portions have a direction of attachment substantially perpendicular to the plane of the second panel of the construction modules.

In one embodiment, said third connecting portion is arranged to be detachably attachable to a complementary fourth connecting portion on a second and/or further construction module. Typically, said fourth connecting portion is arranged to be detachably attachable to a complementary third connecting portion on a second and/or further construction module. Thus, the provision of the third and fourth connecting portions on the modules permit stacking of the modules and allow the temporary structure to be built, securely, in rows or layers.

In another embodiment, said third and fourth connecting portions are provided for detachable attachment to connecting portions located on a base, floor or track member on which the modules may be located and, thus, the temporary structure may be constructed.

In one embodiment, a base, floor or track member may be provided, on which the modules may be located and, thus, the temporary structure may be constructed.

In one embodiment, said base, floor or track member may be provided as a plurality of segments, which may be positioned end to end, forming a base, floor or track for the modules. Alternatively, or additionally, said base, floor or track member may be provided as one or more flexible members, such that they may be rolled up or rolled out when required. The provision of such a feature again improves the efficiency of storing, packing and transporting such components.

In one embodiment, said base, floor or track member may also serve as a top, roof or cap member, which provide a substantially flat and even top surface of the module and/or structure. Typically, said top, roof or cap member may be positioned to provide an exterior face of the second panel with a substantially flat or even surface.

In one embodiment, said base, floor or track member may be provided with a plurality of foot portions. Typically, said foot portions may be adjustable. Thus, said base, floor or track member and associated foot portions serve to provide a stable foundation on which the temporary structure may be based, and the adjustable foot portions enable the structure to be levelled appropriately.

Typically, said foot portions are formed from plastics, metal and/or metal alloy materials.

Typically, said base, floor or track member may include one or more recesses or channel members located along a longitudinal axis thereof. In one embodiment, said at least one recess or channel member is provided shaped to receive at least part of a joining, reinforcement and/or support member.

Thus, the structure, wall or barrier required to be built may be done so from a single principle component, which may be joined to adjacent modules and further modules by rotating and tessellating. Thus, there is no requirement for multiple and complex connecting or joining parts as per systems currently available.

In one embodiment, one or more recesses or channel members are provided on said second, horizontal panels of the construction modules. Typically, said one or more recesses or channel members may be provided along the length of said panel and, thus, the length of the modules. Further typically, said recess or channel member is located on an exterior face of said panel.

In one embodiment, one or more joining, reinforcement and/or support members are provided. Typically, said one or more joining, reinforcement and/or support members are received in said recess or channel member located on said second, horizontal panels of the construction modules. Further typically, said one or more joining, reinforcement and/or support members are provided as elongate members.

In one embodiment, said one or more joining, reinforcement and/or support members are located in the recess or channel members of panels of adjacent, stacked and/or adjoining modules. Thus, said one or more joining, reinforcement and/or support members provide extra support and stability to the temporary structure when constructing the same and once fully built.

Preferably, at least a first portion of said joining member is located in a recess or channel member of a first module, and a second portion of said joining member is located in a recess or channel member of a second module.

In one embodiment, said joining member has a cross-sectional profile shaped so as to prevent the separation of adjacent, stacked and/or adjoining modules. In one embodiment, said joining member has an hour-glass or similar-shaped cross-sectional profile.

In one embodiment, one or more plate members may be provided. Typically, said one or more plate members may be provided to act as joining, reinforcement and/or support members.

In one embodiment, said one or more plate members are provided to be located within the L-shaped profile/cross-section of the module, and thus, within two connected modules of the structure, said modules being provided at 180 degrees relative to one another and connected, so as to form a substantially rectangular profile. Typically, said plate member includes one or more formations and/or recesses about edges thereof which are shaped to engage one or more rib members provided on said modules.

Typically, said plate member has an outer profile shaped to complement the inner profile of the L-shaped construction modules. That is to say, the periphery of the plate member has a profile to complement the profile of the interior faces of the first and second panels forming the construction modules.

In one embodiment, said plate member may be provided to act as an end plate, located at an end of, and within, two connected modules. Alternatively, or in addition, a plurality of plate members may be provided connected with a module.

Typically, said plurality of plate members serves to reinforce a structure formed by the connection of multiple construction modules.

Figure 1C:
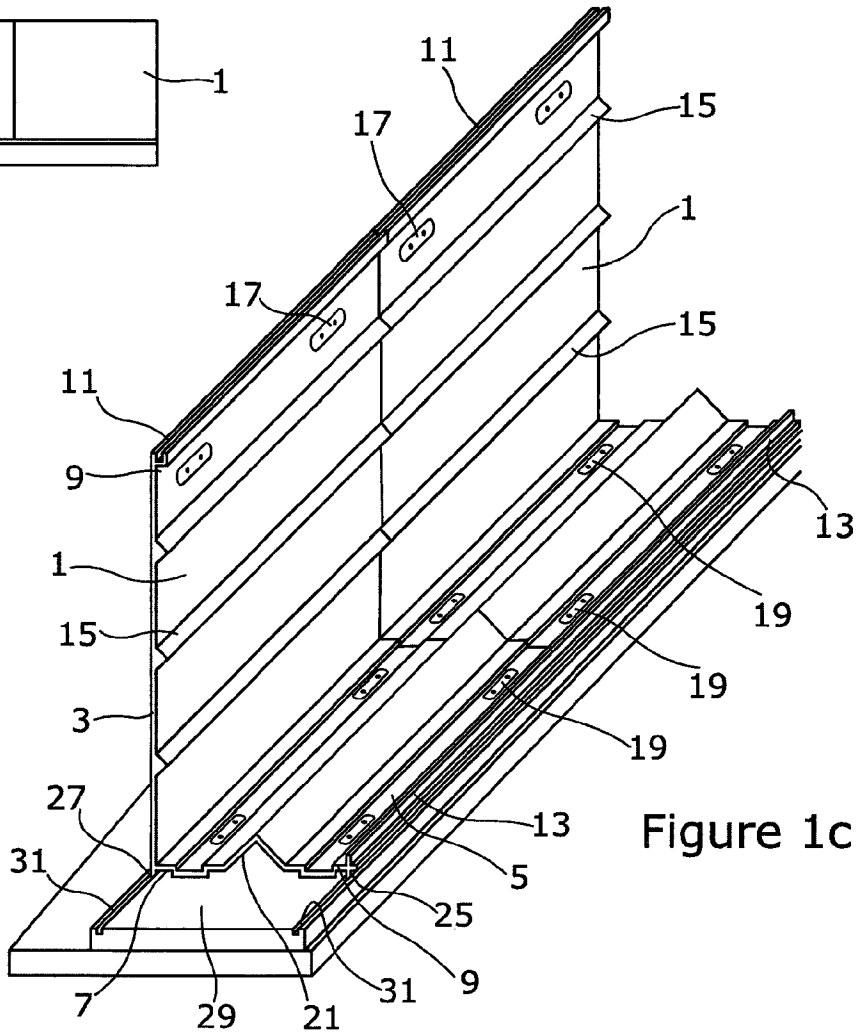
Figure 1B:
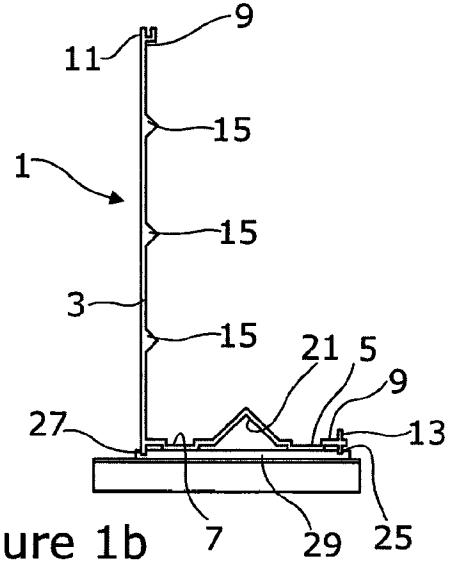
Figures 2A, 2B, 2C:
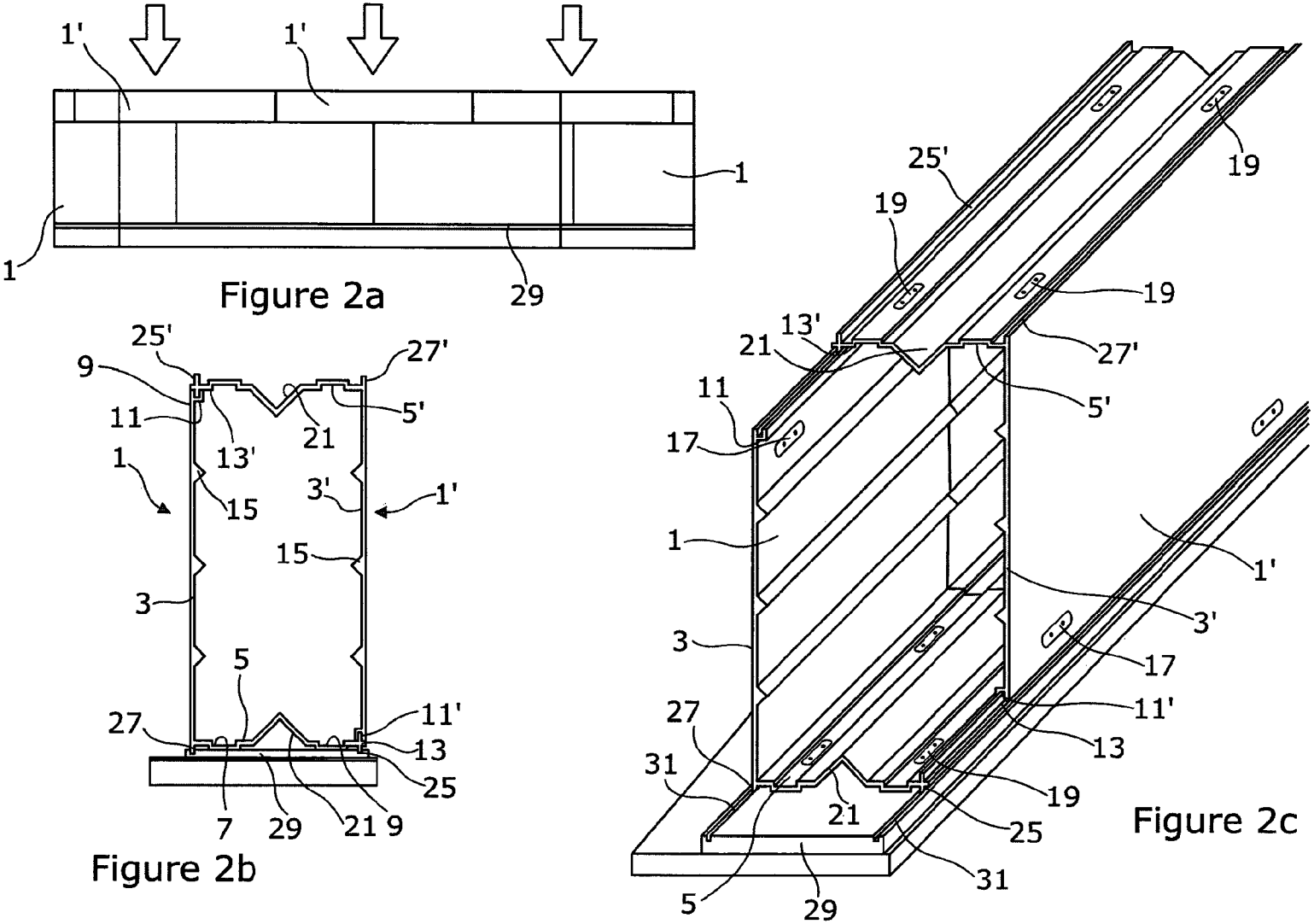
Figure 3C:
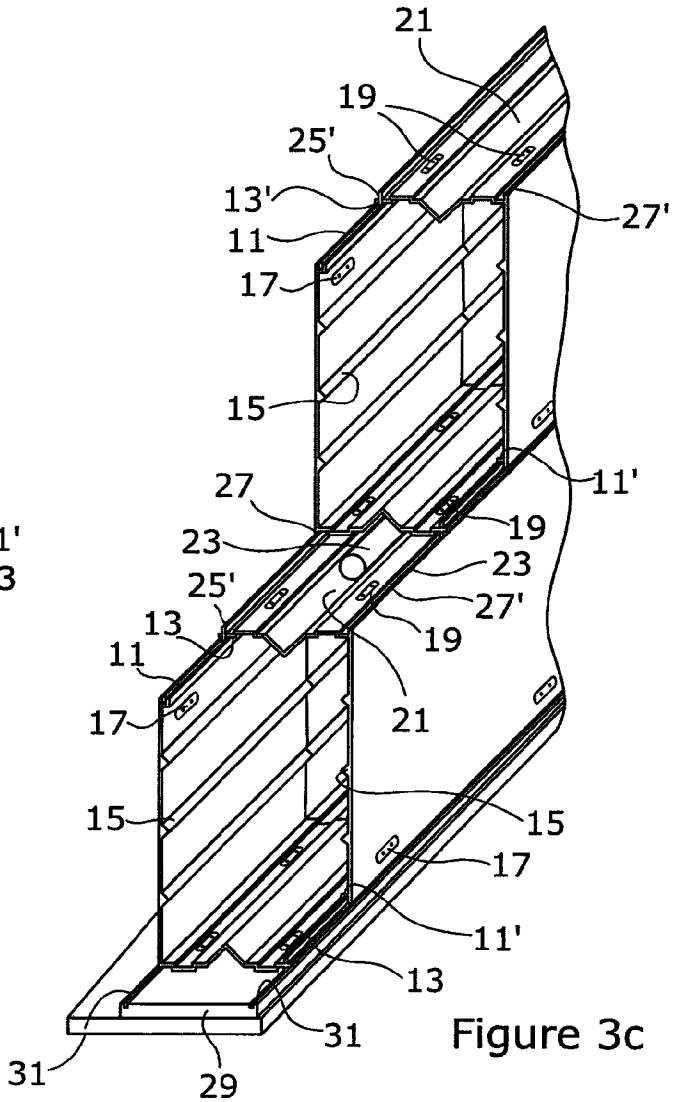
Figure 3B:
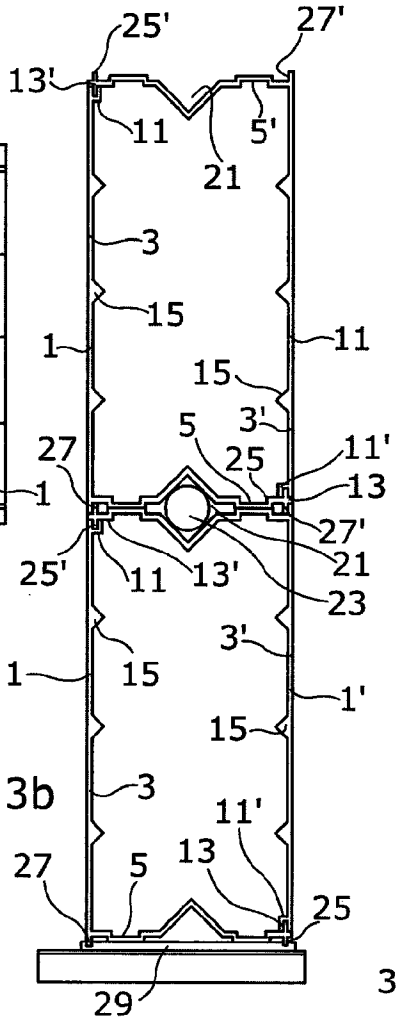
Figure 3A:
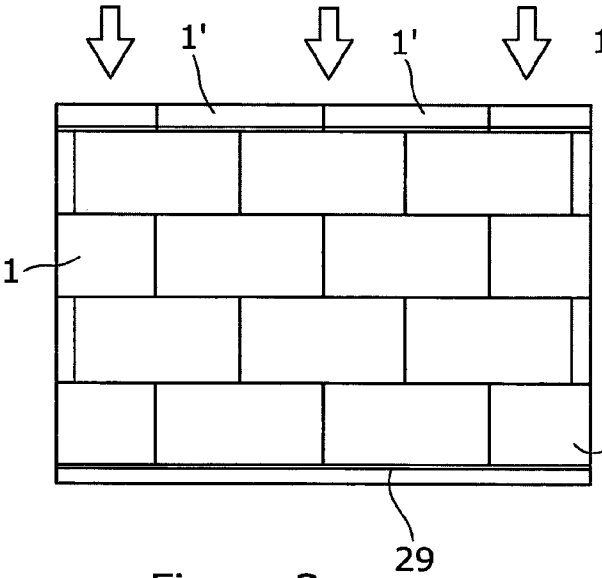
Figure 4A:
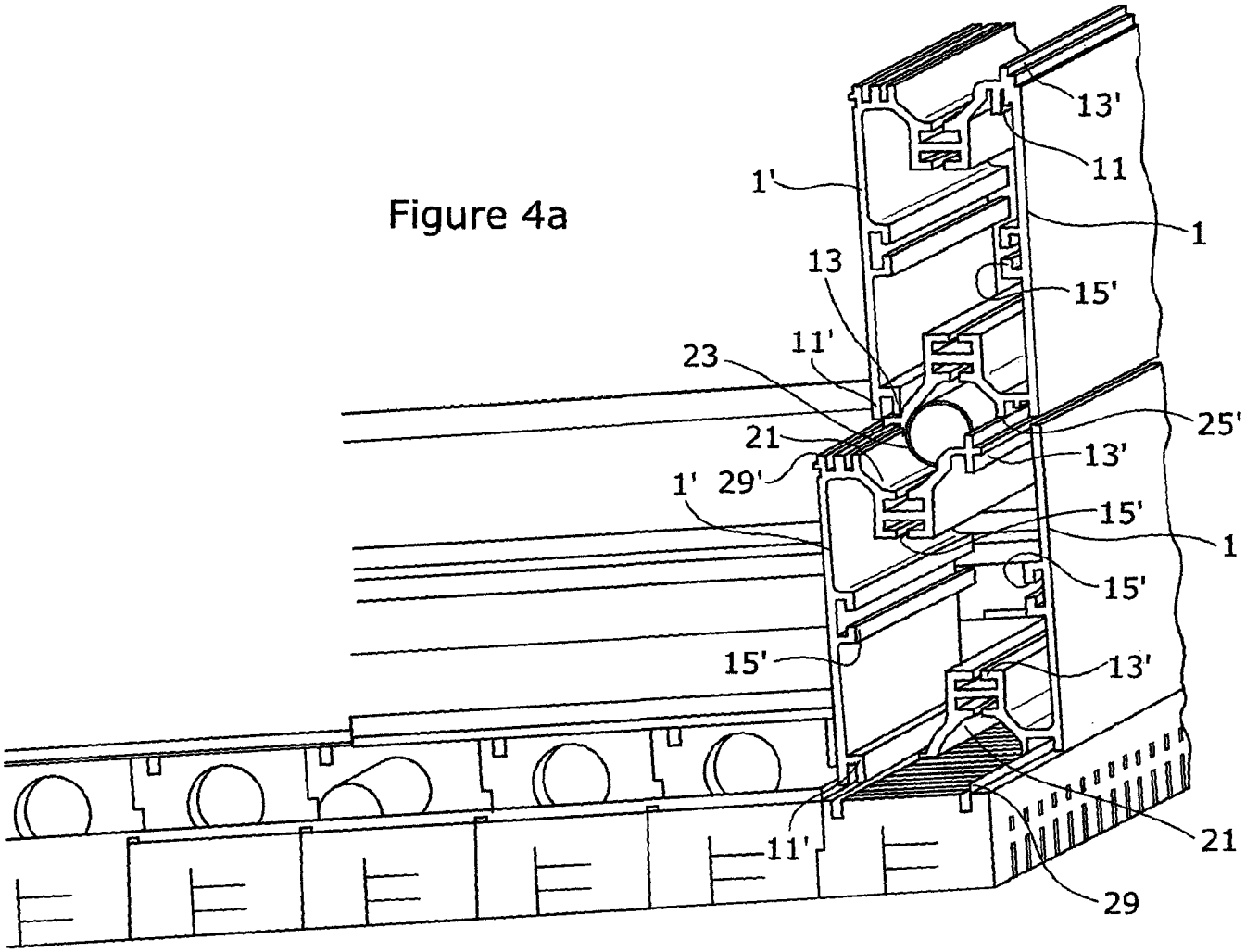
Figure 4B:
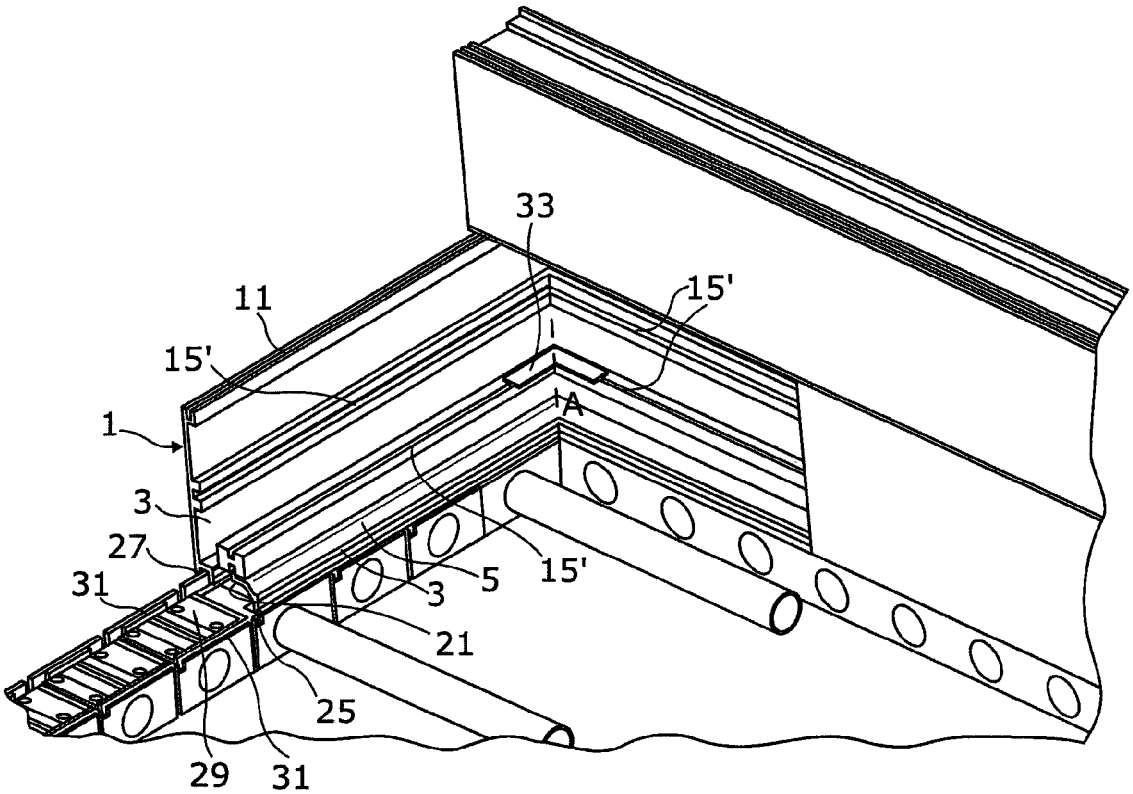
Figures 5A, 5B, 5C, 5D:
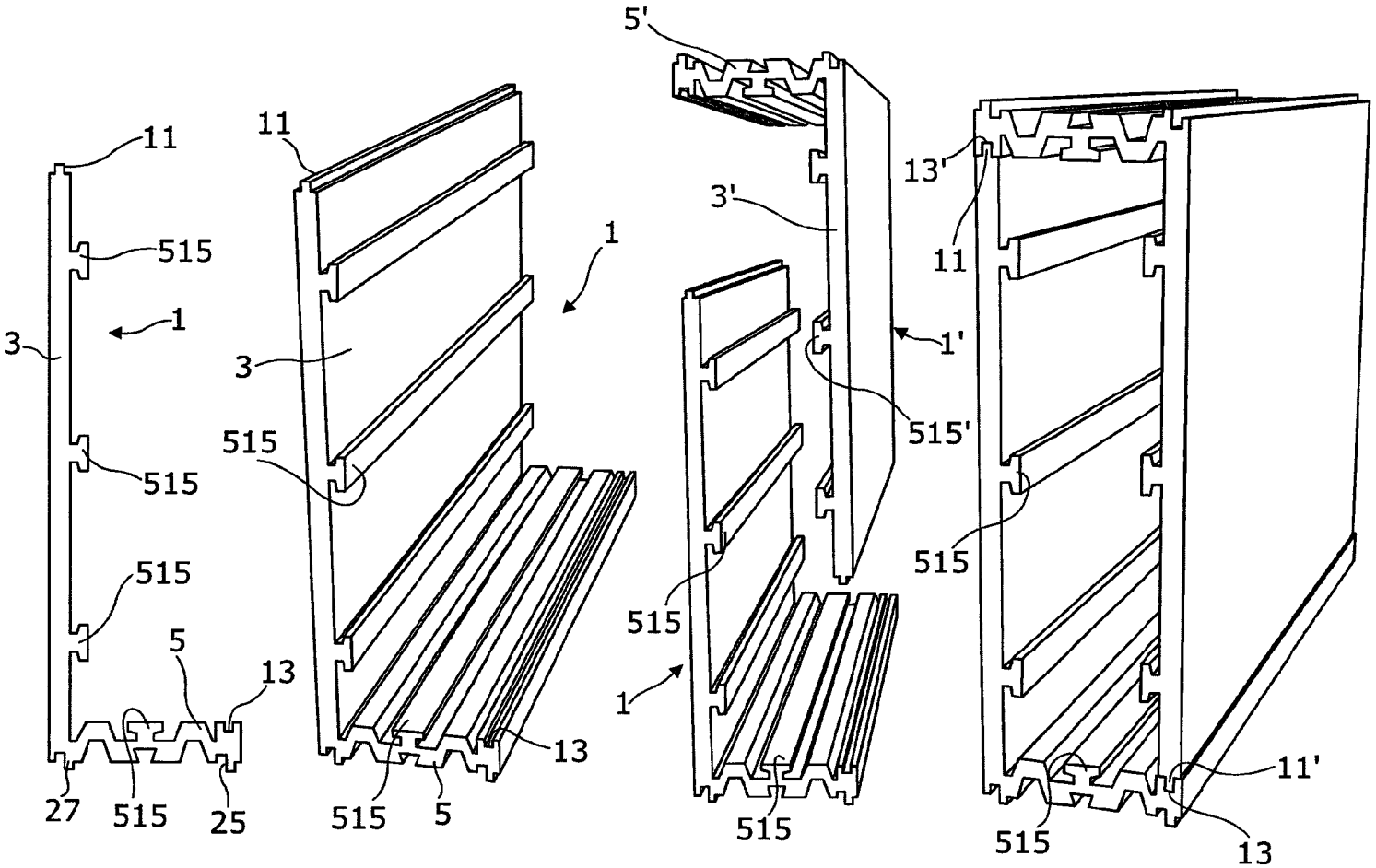
Figures 6A, 6B, 6C, 6D:
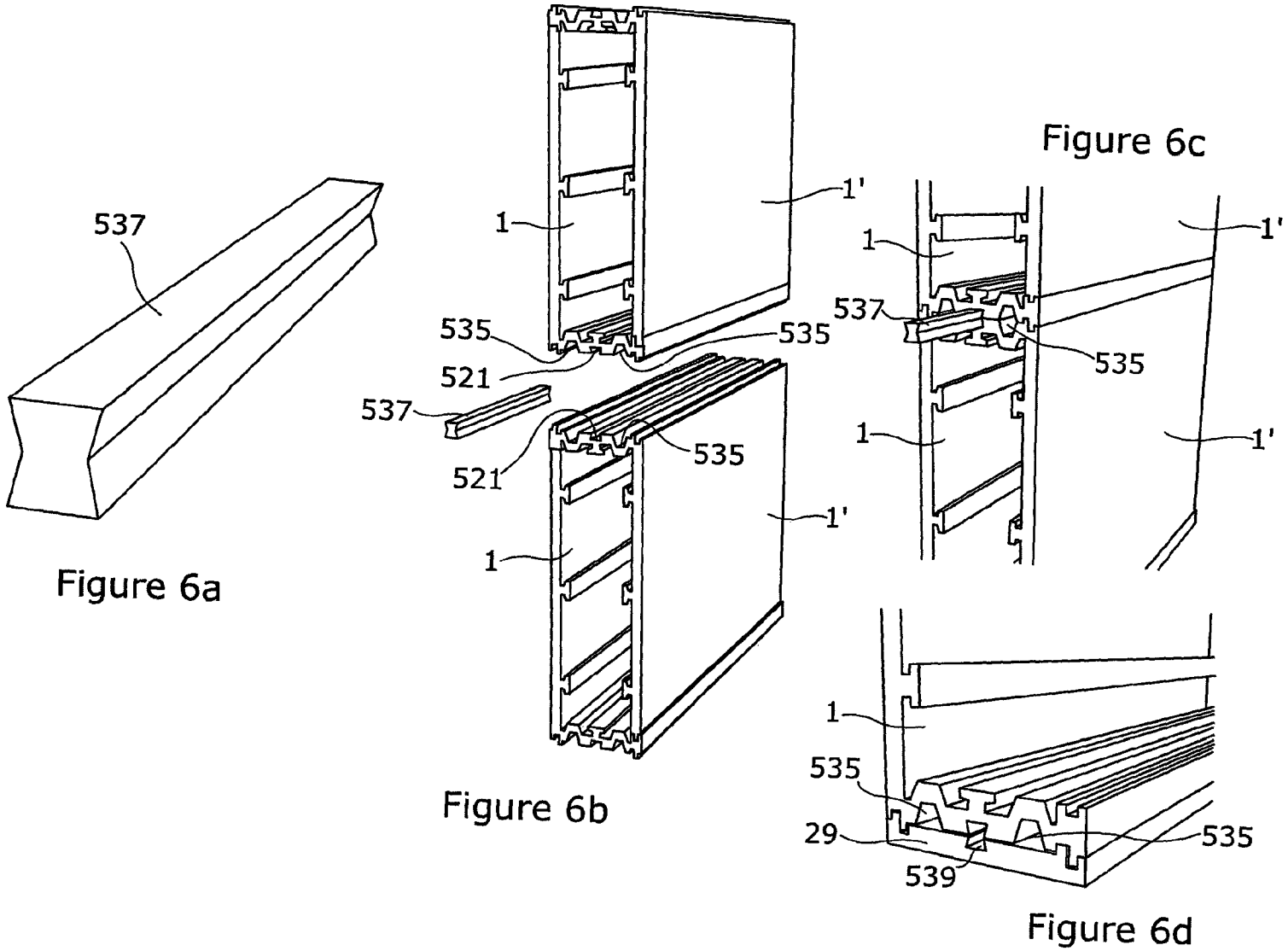
Figures 7A, 7B, 7C:
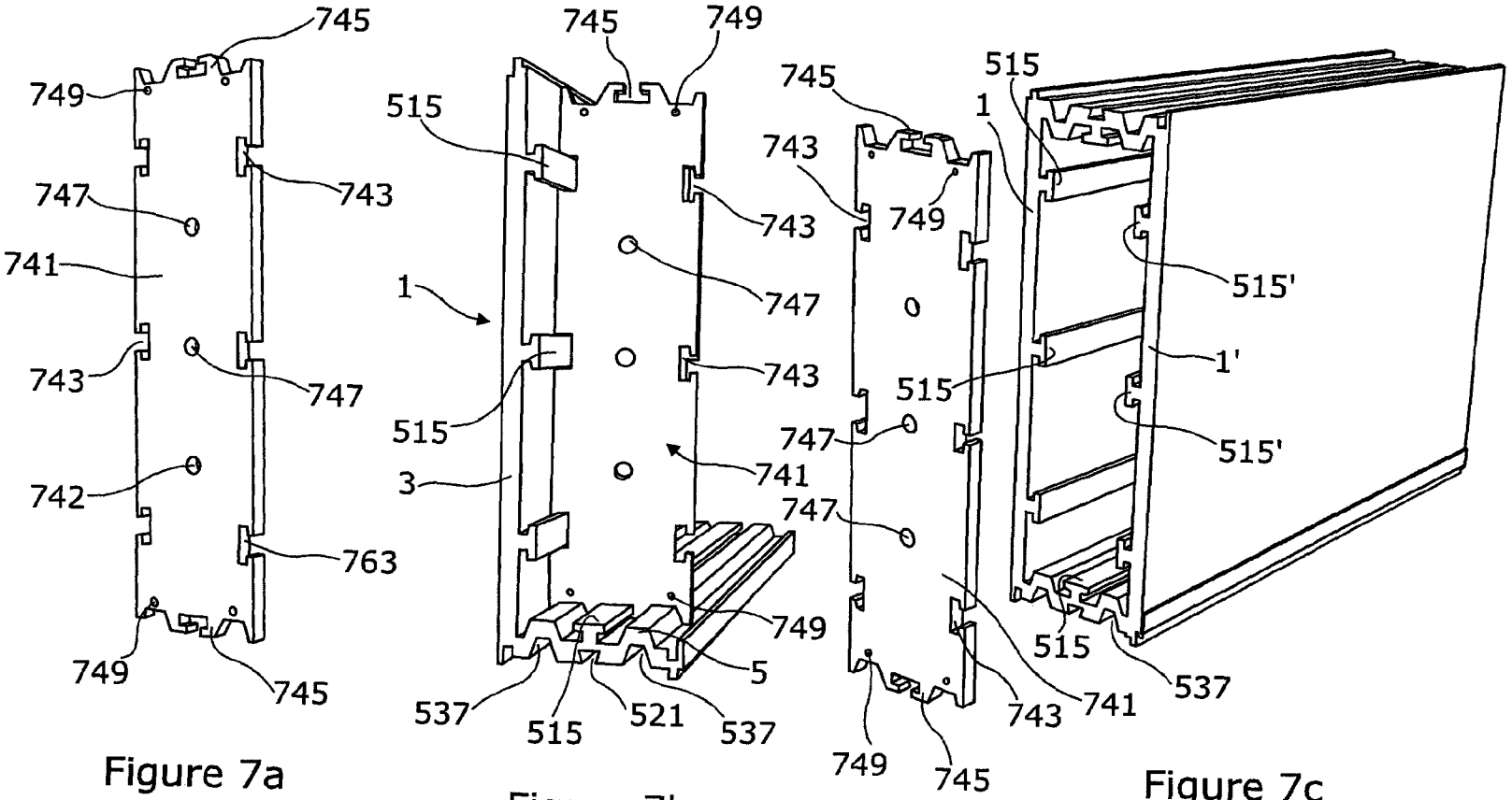

Embodiments of the present invention will now be described with reference to the accompanying figures, wherein:

FIGS. 1*a-c* illustrate views of a construction module for forming a structure in accordance with an embodiment of the present invention;

FIGS. 2*a-c* illustrate views of a plurality of construction modules forming a structure in accordance with an embodiment of the present invention;

FIGS. 3*a-c* illustrate views of a plurality of construction modules forming multiple layers or rows of a structure in accordance with an embodiment of the present invention;

FIGS. 4*a-b* illustrate views of a number of construction modules forming at least part of a structure, in accordance with an embodiment of the present invention;

FIGS. 5*a-d* illustrate further views of construction modules forming a structure in accordance with an embodiment of the present invention;

FIGS. 6*a-d* illustrate a joining member and the joining of at least two constructions modules, in accordance with an embodiment of the present invention; and FIGS. 7*a-c* illustrate views of a plate member provided with construction modules, in accordance with an embodiment of the present invention.

Referring firstly to FIGS. 1*a-c*, there is shown a construction module 1 that can be used to form a larger, temporary structure. In other embodiments of the present invention, the structure may be a permanent or semi-permanent structure. While the following description refers predominantly to the use of construction modules 1 according to the present invention for use with temporary structures, it will be appreciated that the module 1 may also be used to form semi-permanent or permanent structures, as required. The structure that is to be built can vary depending on the specific needs of the user or required by the environment in which it is to be built. For example, the structure may be a simple, low-rising wall to delineate tracks, paths, areas and the like, or it may be a taller, sturdier wall or barrier. In other examples, the construction module 1 may be used to build temporary buildings in which quick and easy assembly and disassembly is required. In other examples, such buildings or structures may need to be in place for a longer period of time, thereby requiring semi-permanent of permanent structures. However, disassembly, if and when required, will still be quick and easy. Each construction module 1 is provided as an elongate member, seen best in FIGS. 1*a* and 1*c*, and has a predominantly L-shaped cross-section, seen best in FIGS. 1*b* and 1*c*. In forming the L-shaped cross-section, the module 1 comprises first and second panels 3, 5, which adjoin one another substantially at right-angles along proximal, longitudinal edges 7, forming a single, integral module 1. Provided at and along the distal edges 9 of the module 1 are connecting portions 11, 13, which are arranged to detachably attach with connecting portions on second and further construction modules, ultimately forming the temporary structure. The connecting portions 11, 13 are provided to detachably attach with complementary connecting portions 13', 11' located on other construction modules 1'. Such attachment is shown in FIGS. 2*a-c*, wherein a further module 1' is provided, rotated 180 degrees to the first module 1 and the first connecting portion 11 of the module 1 attaches to the second, complementary connecting portion 13' of the further module 1'. Likewise, the second connecting portion 13 of the first module 1 subsequently attaches to the first, complementary connecting portion 11' of the further module 1'. This tessellated attachment allows a user to build a temporary structure easily and effectively, while being provided initially with modules 1 that are conveniently shaped so as to enable easy and efficient storage, packing and transport.

As the further module 1' is located on the first module 1, it is done so in an offset position, such that it may attach partially to the first module 1, and also overlap with another module 1 positioned immediately adjacent, as shown most clearly in FIGS. 1*a* and 1*c*, although the arrangement can be seen in FIGS. 2*a* and 2*c*. Such positioning of the inverted/rotated modules 1' therefore not only helps to form the temporary structure and permits attachment in a vertical direction, but the offset nature of the modules 1' with respect to the first-positioned modules 1 provides a direct attachment between laterally positioned segments of modules, thereby providing a more secure structure. Thus, the present invention provides a new and convenient solution overcoming the problems with the prior art, as discussed above. The module 1 of the present invention is provided with an L-shaped cross section such that it is easily and conveniently stored, packaged and transported as required and, therefore, is also lightweight when compared to other systems. It is subsequently easily connected to further modules, ultimately forming a temporary structure. The structure, wall or barrier required to be built may be done so from a single principle component—module 1—which may be joined to adjacent modules 1 and further modules 1' by rotating and tessellating. Thus, there is no requirement for multiple and complex connecting or joining parts as per systems currently available.

The panels 3, 5 that form the module 1 are provided, with respect to the temporary structure when built, as a vertical panel 3 and a horizontal panel 5. The vertical panel 3 ultimately forms at least part of a barrier or wall portion of the temporary structure when formed, and the horizontal panel 5 therefore forms at least part of a base, floor or top of the temporary structure when formed. For the sake of clarity in subsequent discussion, the panels 3, 5 comprise interior and exterior faces with respect to the L-shaped cross-section of the module 1, and which become more apparent as the structure is formed. On the interior face of the vertical panel 3, there is provided at least one, but preferably several rib members 15, which extend along the length of the panel 3 and, hence, the module 1. The rib members 15 are provided so as to give the module 1 and structure, when formed, greater strength as the weight on the module 1 builds. In particular, the rib members 15 will help in preventing any bowing of the module 1 as it supports more weight. On the opposing side of the panel 3, the exterior face is provided as a generally flat or even surface. In some examples, a rib member 515 may also be provide on the interior face of the second panel 5, as is shown in FIGS. 5-7.

As discussed above, a first plurality of construction modules 1 may be provided located adjacent one another end-to-end for a specified length. A second plurality of modules 1', having the same structure, may then be provided, rotated 180 degrees with respect to the first plurality of modules 1 and detachably attached thereto via complementary connecting portions 11, 13 and 11', 13'. Moreover, the modules 1' are positioned on the modules 1 such that they are offset along the length of the construction, thereby providing lateral attachment of the modules 1, 1' when forming the temporary structure. Once attached, the combination of the modules 1, 1' provide a structure having a square or, in the embodiments shown, a rectangular cross-section, which has a substantially hollow interior. The structure, with the hollow interior is, however, provided to be fillable and can be done so with solid or liquid material, or a combination of the two. Further, the temporary structure may be provided to comprise several rows or layers of the connected modules 1, 1', forming a structure of any desired height by the user, shown best in FIGS. 3*a-c*.

In addition to the ribs 15, the vertical panel 3 may also, in some embodiments of the invention, be provided with one or more apertures or holes 17 therein. Such holes 17 may generally be provided at and/or along the distal edge 9 of the panel 3. The purpose served by the provision of the holes 17 is in circumstances where, for example, the temporary structure is to be used as a flood barrier. Any floodwater, as it hits the barrier, may subsequently feed through the holes 17 and into the barrier, which serves two purposes: firstly it naturally fills that barrier to add to its weight, fortifying it; and secondly it enables the structure to absorb and dissipate the energy and force of the floodwater as it hits the barrier, thereby enabling it to maintain its structural integrity more efficiently. Furthermore, one or more holes 19 may also be provided in the horizontal panel 5. These may be located at either or both of the distal 9 and proximal 7 edges of the panel 5. The holes 17 can be provided when multiple layers or rows of modules 1, 1' are required to be built, as per FIGS. 3*a-c*. These holes 17 overlap with corresponding holes 17 on panels 5 of the modules stacked above or below, and therefore allow any material poured in from the top to dissipate downwards, preventing there from being too much weight higher up the structure and over-balancing it or providing it with too high a centre of gravity.

The horizontal panel 5 of the module 1 may also be provided with a recess, channel 21 or the like, which extends along the length of that panel 5 and, thus, the length of the module 1. As can be seen best in FIG. 1*a*, the recessed portion 21 is located on the exterior face of the panel 5, and thus creates a ridge along the interior face. FIG. 1*c* illustrates the recess/channel 21 extending along the lengths of two adjacent modules 1 on the panels 5. The purpose of the recess/channel portions 21 is to provide a further means by which to reinforce the temporary structure as it is built. As is shown best in FIGS. 3*b* and 3*c*, when multiple layers or rows of modules are formed, the recesses overlap, forming a contained channel 21 along the length of the modules and intermediate each row or layer. Consequently, one or more reinforcement and/or support members in the form of a pole or scaffold member 23 may be located within the channels 21 in between the rows or layers of stacked/adjoining modules. Thus, the provision of the poles/scaffold members 23 gives extra support and stability to the temporary structure when constructing the same and once fully built.

In other examples of the present invention, in particular, those shown in FIGS. 6*a-c*, there may be provided more than one channel/recessed portion, and in this case there is provided one central channel 521, and two outer channels 535. The outer channels are provided for the receipt of one or more cables, wires and the like, while the central channel 521 is provided to receive at least part of a joining member 537. The joining member 537 is provided as an elongate bar which, typically can be slid into an hourglass-shaped channel 521 that is created by the second panels 5, 5' two adjoining, adjacent and/or stacked modules 1, 1'. The hourglass, or "dickie-bow" shape of the joining member 537 and thus the channel 521 ensures that once the bar 537 is inserted, linear separation of the modules is substantially prohibited. Thus, the provision of a joining member 537 as described above serves to add further stability and connectivity between adjacent, stacked and/or adjoining modules 1, 1', thereby improving the overall structural integrity of a structure formed from a plurality of the construction modules.

As discussed above, each module 1 is provided with first and second connection portions 11, 13, which detachably attach to complementary second and first connecting portions 13', 11' on a further module 1'. The first connecting portion 11 is provided along the distal edge 9 of what forms the vertical panel 3, and the second connection portion 13 is provided along the distal edge 9 of what forms the horizontal panel 5. The portions 11, 13 are shown most clearly in FIG. 1*b*, and the interaction/attachment between a pair of modules 1, 1' is shown in the cross-sectional view in FIG. 2*b*. The first connection portion 11, is provided as a groove, slot, trough or channel member extending along the length of the module 1. The connection portion 11 is formed on the interior face of the panel 3, however, the direction of attachment into the groove lies substantially parallel with plane of the panel 3. The detachable attachment between the first and second connection portions 11, 13 occurs via linear engagement of the two complementary portions, typically, as in a male-female engagement. This can be a snap-fit or push-fit engagement and the present embodiment illustrates the portions attaching via a tongue and groove arrangement. Thus, as the first connecting portion 11 is provided as a groove extending along the length of the module, the second connecting portion 13 is provided as a tongue, ridge or other projecting member and is located on the interior face of the horizontal panel 5, along its distal edge 9. In order to engage with the groove member on a further module, the second connecting portion 13 therefore has a direction of attachment substantially perpendicular to the plane of the horizontal panel 5. Of course, in some embodiments of the present invention, for example, those shown in FIGS. 5-7, the first connecting portion 11 may instead be provided as a tongue, ridge or other projecting member, and the second connecting portion 13, may be provided as a groove, slot, trough or channel member extending along the length of the module 1. Thus, as the engagement between two modules is in a substantially vertical direction, any stacking of modules to form numerous layers or rows will not dislodge the attachment and will serve, rather, to maintain such a connection. It will be appreciated that while it is preferable to provide the first and second connecting portions in the present arrangement, it would also be possible for the two portions to switch with one another such that the first connecting portion is a tongue member and the second connecting portion is a groove member.

The module 1 is also provided with further connecting portions. Such portions are provided to enable the stacking of multiple layers or rows of modules 1, and also provide for a secure attachment of the lowermost row or layer to the ground/floor or a base/track member. A third connecting portion 25 is provided on the module 1 and located along the distal edge 9 of the horizontal panel 5, and on the exterior face thereof. Additionally, a fourth connecting portion 27 is also provided on the exterior face of the panel 5, however is located along the proximal edge thereof. The direction of attachment of both of these portions is therefore perpendicular to the plane of the panel 5. As with the first and second connecting portions arranged to form detachable attachments with complementary connecting portions on another module, the third portion 25 is arranged to be detachably attachable to a complementary fourth connecting portion 27' on a further module 1'. Likewise, the fourth connecting portion 27 on the module 1 is arranged to be detachably attached to a complementary third connecting portion 25' on the other module 1', thereby providing a secure attachment between layers or rows of modules when stacking the same to form a taller temporary structure.

Furthermore, the third and fourth connecting portions 25, 27 may also be provided to form detachable attachments with corresponding portions on a base, floor or track member 29 on which the modules may be located and, thus, the temporary structure may be constructed. The base 29 is provided so that the modules 1, when constructed, have a level and sturdy base on which to be set. In the present embodiment, the base 29 is provided with a pair of grooves or tracks 31, in which the third and fourth connecting portions 25, 27 may be located, in a tongue and groove manner. In some examples, as shown in FIG. 6*d*, the base 29 may be provided with a central channel 539 shaped so as to receive at least part of a joining member 537 as discussed above, securing the module 1 to the base 29. It will, however, be appreciated that other forms of attachment may be possible and the connecting portions 25, 27, 31 may be formed as such. The base 29 may be provided as a number of segments, which can be positioned end to end, forming an elongate base, floor or track for the modules 1. These, when not in use, may be easily stored by stacking. In other embodiments, the base member 29 may additionally, or alternatively be provided in a more flexible material, such that it may be rollable. Thus, it may be stored, when not in use, in a rolled up fashion and when a user requires such a segment, simply rolls it out like a carpet. The provision of such a feature again improves the efficiency of storing, packing and transporting such components. Each base segment 29 may also be provided with feet (not shown), which may be adjustable and further aid a user in providing as level a base/track as possible on which to construct the temporary structure using the modules 1. The feet may be formed from plastics, metal and/or metal alloy materials. In some examples of the present invention, the base segment 29 may also double up as roofing, capping or a topping off portions for the modules 1. That is to say, the segment 29 may serve to flatten out the horizontal panel 5 of the module 1, while also provided a cover for those holes 19 located therein. Thus, the structure, wall or barrier required to be built may be done so from a single principle component, which may be joined to adjacent modules 1 and further modules 1' by rotating and tessellating. Thus, there is no requirement for multiple and complex connecting or joining parts as per systems currently available.

In order to permit the provision of corners in the temporary structure, some of the modules 1 may be provided in an adapted form. This may be achieved by providing modules 1 wherein the horizontal panel 5 is mitred or bevelled (for example at point A on FIG. 4*b*). Such a module 1 can then act as a corner portion ensuring there are no gaps in the structure. Of course, since the structure comprises tessellated arrangements of the module 1, some modules will also be adapted to provide the horizontal panel 5 with an extended portion at a predetermined angle. This may act in unison with bevelled corner portions when module pairs are inverted with respect to one another. Reduced length modules may also be provided in order that as one approaches an end or corner of the temporary structure—be it a barrier, wall or building—the end or corner will be flush and clean, as required. In other examples of the present invention, the ribs 15 may be provided with a specific shape or cross-section. In one embodiment, the ribs 15 may be provided with a substantially C-shaped cross-section 15', as shown in FIGS. 4*a-b*. In other embodiments of the invention, the ribs may be provided with a substantially T-shaped cross-section 515, as is shown in FIGS. 5-7. Subsequently, one or more joining portions may also be provided having complementary profiles in order to fit or clip within the cross-section of the ribs 15, akin to a male-female engagement. For example, a joining member having a T-shaped cross-section may be provided to locate within ribs 15, thereby joining adjacent modules 1 and further strengthening the lateral joins between modules 1. These may also be provided to engage the ribs 15 at corner sections, ensuring a secure join between modules. Such formations may also be provided on, for example, the interior face of the horizontal panel 5 on the opposing side of the recess portion 21, wherein such a formation 15' may also be provided. The joining member 33 is illustrated in FIG. 4*b* as linking the formations on the horizontal panel 5, but equally an appropriately shaped joining member 33 can be arranged to be located on the ribs 15' of the vertical panel 3.

Furthermore, in instances where a corner portion is not required and the wall or barrier is simply to terminate, end caps or covers (not shown) may also be provided, thereby capping of the wall or barrier and preventing exposure of the hollow (or filled) interior of the barrier. Although the above description refers to the construction of temporary structures, the person skilled in the art will appreciate that the present invention could also be used for structures of a semi-permanent or permanent nature, depending on the ultimate usage requirements.

Finally, and referring now to FIGS. 7*a-c*, the present invention further includes the provision of one or more plate members 741, which are provided to act as joining, reinforcement and/or support members, and/or as end plates for modules 1 which are joined together. as can be seen from FIG. 7*b*, the plate member 741 is provided to be located within the L-shaped profile of the module 1, and is shaped to have an outer profile which is complementary to the inner profile of the L-shape. Thus, the edges of the plate member 741 are provided to engage with at least the rib members 515 provided in the interior faces of the first 3 and/or second 5 panels. It is particularly advantageous to provide the ribs 515 as having T-shaped profiles, and correspondingly, a series of T-shaped recesses 743 are located around the edges of the plate 741. A C-shaped formation 745 is provided at opposing ends of the plate 741 to engage the T-shaped ribs 515 on the second panel while also matching the profile created by the channels 537. In some examples, not shown, the T-shaped recesses 743 may instead be provided as T-shaped protrusions provided to engage the C-shaped ribs 15' shown in FIGS. 4*a-b*.

The plate member 741 can be provided to act as an end plate, located at an end of, and within, two connected modules 1 (FIG. 7*c* illustrates how the plate may be positioned/moved toward two connected modules 1, 1'), said modules being provided at 180 degree relative to one another and connected, so as to form a substantially rectangular profile. Additionally, or alternatively, a plurality of plate members 741 may be provided connected with a module 1, a located along the length of the same within its profile. These plate members 741 will then serve to reinforce a structure formed by the connection of multiple construction modules 1. The plate members 741 are detachably attachable to the module 1 via a sliding and/or friction fit arrangement of recesses/formations 743, 745 in engagement with the ribs 515 of the module 1. The sliding and friction fit arrangement is preferably enabled via the provision of a clamp and release mechanism. Finally, the plate 741 may include one or more apertures located therethrough. These may be provided as centrally located hole 747 to enable the connection of said plate member to another article, structure or the like. They may also be provided to permit one or more cables, wires or the like to be fed therethrough. Further apertures in the form of pilot holes 749 may also be provided on the plate 741. These may be provided at, for example, 45 degrees and can be used, with self-tapping screws, to lock the plate 741 in place, if required.

The invention claimed is:

1. A construction module for constructing and forming a temporary structure, said module comprising:

an elongate member having a substantially L-shaped cross-section;

said module comprising at least first and second panels provided adjacent and substantially at right-angles to one another, along a length of said module, said panels connected to form said L-shaped cross-section;

said member provided with connecting portions arranged to detachably attach with connecting portions on second and further construction modules, to form said structure; and said connecting portions being arranged to permit detachable attachment of said module to second and/or further modules rotated 180 degrees thereto, in an inverted manner;

said first panel being provided to be a substantially vertical panel, forming at least part of a face on a side of said module;

said second panel being provided to be a substantially horizontal panel, forming at least part of a base, floor or top of said module; and wherein said module is configured for detachable attachment to second and/or further modules, positioned offset along the length of the first module, such that said module overlaps with said second and/or further modules rotated 180 degrees thereto.

2. A construction module according to claim 1, wherein said connecting portions are arranged to detachably attach with complementary connection portions on second and further construction modules in a predetermined pattern.

3. A construction module according to claim 1, wherein one or more rib members are provided on at least said first panel, and said one or more rib members are located along the length of the first panel and, thus, the length of the module, and are located on an interior face of said first panel.

4. A construction module according to claim 3, wherein said one or more rib members are provided with a substantially C- or T-shaped cross-section and are arranged to receive one or more joining reinforcement and/or support members.

5. A construction module according to claim 1, wherein a first connecting portion is provided on said first panel, and at least a second connecting portion is provided on said second panel, said first connecting portion being arranged to be detachably attachable to a complementary second connecting portion on a second and/or further construction module, and said second connecting portion is arranged to be detachably attachable to a complementary first connecting portion on a second and/or further construction module.

6. A construction module according to claim 1, wherein one or more plate members are provided associated with the module, said one or more plate members being provided to be located within the L-shaped cross-section of the module and having an outer profile shaped to complement an inner profile of the L-shaped construction module.

7. A construction module according to claim 6, wherein at least one of the one or more plate members is provided to act as an end plate, located at an end of, and within, two connected modules, said modules being provided at 180 degrees relative to one another and connected, so as to form a substantially rectangular profile.

8. A temporary structure formed and constructed from at least two or more construction modules according to claim 1.

9. A temporary structure, said structure formed from two or more construction modules according to claim 1 detachably attached to one another, said structure comprising a first plurality of construction modules located adjacent one another along a longitudinal axis;

at least a second plurality of construction modules provided located adjacent one another along a longitudinal axis and rotated 180 degrees with respect to said first plurality of construction modules, said rotation being about the longitudinal axis of the construction modules; and wherein construction modules of the second plurality are positioned offset from construction modules of the first plurality when detachably attached thereto, along the longitudinal axis thereof.

10. A temporary structure according to claim 9, wherein a base, floor or track member is provided, on which the modules are located and, thus, the structure can be constructed.

11. A temporary structure according to claim 9, wherein one or more joining members are provided.

12. A temporary structure according to claim 11, wherein at least a first portion of said joining member is located in a recess or channel member of a first module, and a second portion of said joining member is located in a recess or channel member of a second module.

13. A temporary structure according to claim 9, wherein one or more plate members are provided.

14. A temporary structure according to claim 13, wherein said one or more plate members are provided to be located within the L-shaped profile/cross-section of the module, and thus, within two connected modules of the structure, said modules being provided at 180 degrees relative to one another and connected, so as to form a substantially rectangular profile.

15. A temporary structure according to claim 13, wherein said plate member has an outer profile shaped to complement the inner profile of the L-shaped construction modules.

* * * * *